US008579129B2

(12) United States Patent
Gruenwald et al.

(10) Patent No.: US 8,579,129 B2
(45) Date of Patent: Nov. 12, 2013

(54) WATER BOTTLE WITH DOSAGE ON BOTTOM

(76) Inventors: Eric William Gruenwald, Dallas, TX (US); Lawrence Lambelet, Flemington, NJ (US); Patrick James Mulligan, Dallas, TX (US)

( * ) Notice: Subject to any disclaimer, the term of this patent is extended or adjusted under 35 U.S.C. 154(b) by 356 days.

(21) Appl. No.: 12/469,731

(22) Filed: May 21, 2009

(65) Prior Publication Data

US 2010/0181275 A1 Jul. 22, 2010

Related U.S. Application Data

(60) Provisional application No. 61/145,528, filed on Jan. 17, 2009.

(51) Int. Cl.
*B65D 77/04* (2006.01)

(52) U.S. Cl.
USPC ..... 215/6

(58) Field of Classification Search
USPC ..... 215/6, 383, 263; 220/85 R, 23; 134/6, 134/42
See application file for complete search history.

(56) References Cited

U.S. PATENT DOCUMENTS

| | | | | |
|---|---|---|---|---|
| 1,798,339 | A | 3/1931 | Soulis | |
| 2,292,413 | A | 8/1942 | Taylor | |
| 3,367,484 | A | 2/1968 | Nelson | |
| 4,416,370 | A * | 11/1983 | Beall | 206/217 |
| 4,651,890 | A * | 3/1987 | Coker et al. | 220/694 |
| 4,923,702 | A * | 5/1990 | Powell et al. | 220/521 |
| 5,419,436 | A | 5/1995 | Powell | |
| 6,311,860 | B1 | 11/2001 | Reidinger | |
| 2004/0149598 | A1 | 8/2004 | Scarla | |
| 2004/0262173 | A1 | 12/2004 | Buesching | |
| 2005/0218148 | A1 | 10/2005 | Boltshauser | |
| 2005/0284792 | A1 | 12/2005 | Gopinathan | |
| 2006/0060479 | A1 | 3/2006 | Tedford | |
| 2008/0230504 | A1 * | 9/2008 | Nowzari | 215/6 |
| 2008/0302802 | A1 | 12/2008 | Ramsden | |

* cited by examiner

*Primary Examiner* — Anthony Stashick
*Assistant Examiner* — Cynthia Collado
(74) *Attorney, Agent, or Firm* — Lawrence Lambelet

(57) ABSTRACT

A solid dosage preparation is provided with a bottle of water. The solid dosage preparation is contained within a cavity at the bottom of the bottle and held captive therein by a heat-sealed lidding. The lidding indicates an attempted tampering event by limiting the means for opening to a witnessing tear. The bottle stands on its cap to provide clear viewing of the containment area.

10 Claims, 4 Drawing Sheets

WATER BOTTLE WITH DOSAGE ON BOTTOM

CROSS-REFERENCE TO RELATED APPLICATIONS

Priority is claimed to Provisional Application 61/145,528, filed Jan. 17, 2009.

FIELD OF THE INVENTION

This invention relates to bottled water products, and more particularly to a nutritionally enhanced drink.

BACKGROUND OF THE INVENTION

Additives are commonly sold in combination with bottled water. Currently marketed examples include energy, or health, drinks, where the additive is provided in solution form. Other examples include a medication where the bottled water is supplied simply as a convenience for washing down a pill or a capsule.

In particular instances involving nutritional supplements, however, it is useful to supply the supplement in solid dosage form, similar to the medication example. Doing so improves the shelf stability of a natural active ingredient, and particularly one of a biological derivation, which might otherwise degrade or lose potency over time when in dissolution.

In contrast with the medication circumstance, however, the water is not just a convenience for administering the dosage. It is also a measured amount of ingredient required for the best metabolic results. Therefore, the means for combining the two components into a single package is an important aspect of the product put-up.

The art is replete with bottled liquid products where some adjunct product is packaged in or on the bottle closure. Alternatively, the bottle itself might play a dual role in the packaging by providing an exterior location for attachment purposes. Most bottles for bottled liquid products are fabricated by molding. The molding technology lends itself to creating cavities, or recesses, in the sidewalls or bottom to provide a nesting location for the adjunct component.

In the case of blow-molded bottles, which are typically used for bottled water products, a natural recess is provided at the bottom where the parison is stubbed off. The parison is the preform tube which is expanded into the shape provided by a female mold by blowing air, or another gas, through an open end called a gate. A protruding gate vestige is left on the bottom where a concavity recesses it out of the way. This recess might provide a handy location for storing a solid dosage preparation.

Solid dosage preparations placed on the exterior recessed bottom of open-topped drinking cups or tumblers are known in the art. U.S. Patent Application 2004/0149598 to Scarla, for example, attaches a breath freshener to the bottom of a disposable cup, such as a STARBUCKS™ coffee cup. In U.S. Pat. No. 1,798,339 to Soulis, a tablet, or a powder composition in a pouch is attached to the raised bottom of a paper cup. These containers, however, while temporarily filled for drinking, do not contain the liquid product, in the sense of put-up packaging. Even if they were to be transformed into a shelf package by means of filling and applying a sealing closure, they provide little physical, and no safety, protection for the solid dosage component, not to mention failing to provide self-stability for the liquid component.

Sealed-closure bottled liquid products, where an adjunct component is conveyed therewith at or near the bottom, are also known. In U.S. Patent Application 2005/0284792 to Gopinathan, a multi-component migraine kit is stored in a separate container comprising a false bottom to a water bottle. In U.S. Patent Application 2004/0262173 to Buesching, a medication is provided in an end-cap which is press-fit to the posterior of a bottle containing a liquid, such as water. An additional container is required, however, in each of these cases. The additional container represents increased cost and assembly complication. Furthermore, the accompanying product is unprotected with regard to tampering. Still furthermore, the product, in its location underneath the bottle, is not always visible to the consumer of the product.

The prior art is silent regarding the use of an already-existing concavity in most water bottles for the simplified concomitant conveyance of a solid dosage preparation in a way that provides both tamper safety and physical protection for the preparation, and in a manner that places the preparation in full view for verification by the user.

SUMMARY OF THE INVENTION

In view of the above-mentioned unfulfilled needs, the present invention embodies, but is not limited by, the following objects and advantages:

A first objective of the present invention is to provide a solid dosage preparation together with a bottle of water.

A second objective is to provide the solid dosage preparation in a recessed location at the bottom of the bottle.

A third objective is to limit the packaging components of the assembly to, at most, a bottle, a closure and a lidding.

A fourth objective is to provide protection with respect to handling damage for the solid dosage preparation.

A fifth objective is to render both the water and the solid dosage preparation secure from tampering.

A sixth objective is to stand the bottle so that the bottom is in view.

In a preferred embodiment of the present invention, an enhanced water product combined with a safety feature comprises a water bottle containing water and having an elongated body with a neck finish on one end and a concave bottom on the other end. The concave bottom has a first annular ring at the periphery of the elongated body and a second annular ring recessed from, and inboard of, the first annular ring. The second annular ring has a flat surface defining a cavity at the periphery thereof with the concave bottom. The neck finish is sealed with a closure. A solid dosage preparation is protectively housed in the cavity and retained by a means for retaining. An integrated means for providing an indication of tampering, should pre-purchase access to the cavity be attempted, is included.

In a particularly preferred embodiment, the means for retaining comprises a lid bonded to the flat surface of the second annular ring. The integrated means for providing an indication of tampering comprises a frustum wall section joining the first annular ring and the second annular ring. The frustum wall section provides an abutment surface for the lid. The abutment surface renders the edge of the lid abutted thereto substantially inaccessible for the purpose of peeling it away and exposing the cavity. With a lid that is frangible, the integrated means for providing an indication of tampering further comprises at least one tab extending from the periphery of the lid, the periphery having at least one notch adjacent the tab. The notch serves to break the edge so as to propagate a tear in the lid when the tab is lifted. The tear gives a preferred access to the cavity, but also gives evidence of any prior attempt to gain access.

In another particularly preferred embodiment, the lid is a clear film and the bottle is oriented bottom-up with the use of a stand-up cap. This combination of features allows for the visual inspection of the solid dosage preparation.

As this is not intended to be an exhaustive recitation, other embodiments may be learned from practicing the invention or may otherwise become apparent to those skilled in the art.

DESCRIPTION OF THE DRAWINGS

Various other objects, features and attendant advantages of the present invention will become fully appreciated as the same becomes better understood through the accompanying drawings, in which like reference characters designate the same or similar parts throughout the several views, and wherein.

DETAILED DESCRIPTION OF THE PREFERRED EMBODIMENT

Figure 1:
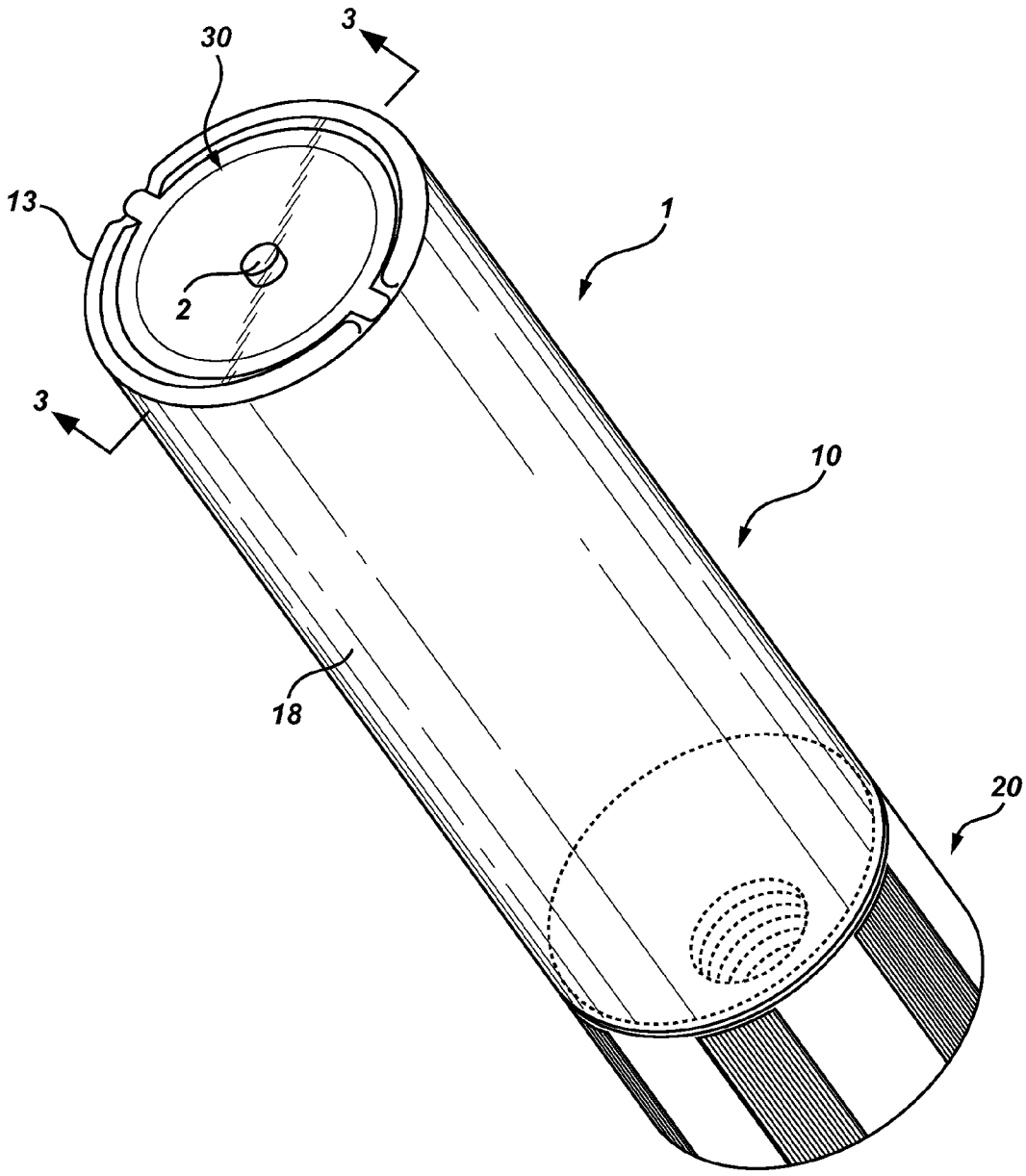
FIG. 1 is a perspective view of the invention.
Figure 2:
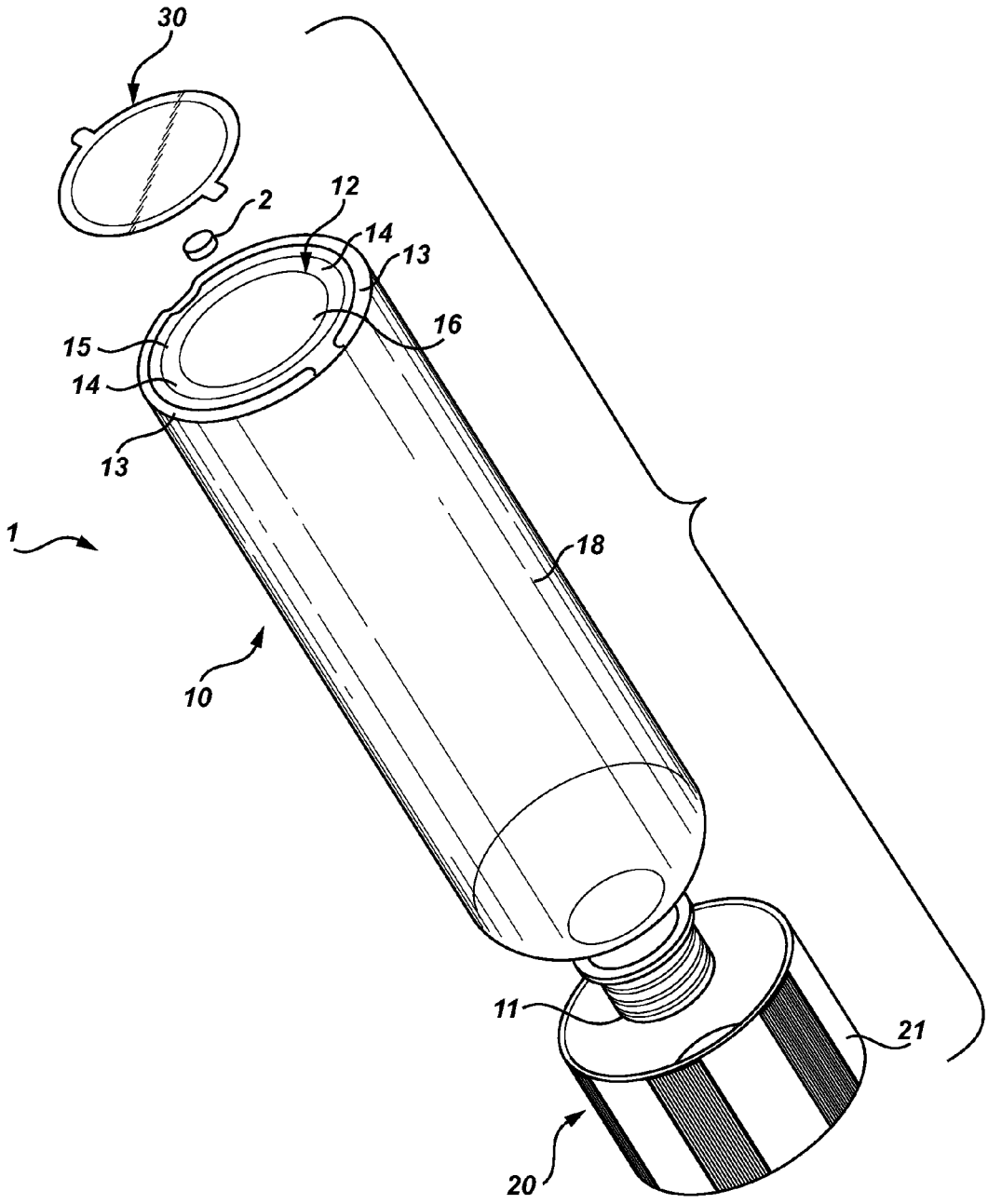
FIG. 2 is an exploded view in perspective.

The major components of an enhanced water product 1 are best shown in FIGS. 1 and 2. A solid dosage preparation 2 is located in the bottom of a bottle 10 and retained therein by a means for retaining 30. A closure 20 sealingly closes bottle 10, containing water 17 (not shown) inside, by threading to a neck finish 11.

As shown in FIG. 2, bottle 10 has an elongated body with a concave bottom 12 opposite neck finish 11. Concave bottom 12 has a first annular ring 13 at the periphery of the body. A second annular ring 14 is disposed inside of, and recessed away from, first annular ring 13. Second annular ring 14 has a flat surface 15, the inside periphery of which defines a cavity 16 with the concave bottom 12.

When bottle 10 is standing on first annular ring 13, as, for example, when closure 20 is removed for drinking, second annular ring 14 is protectively offset from the substrate surface. Similarly, when bottle 10 is standing on closure 20 in a bottom-up position, first annular ring 13 is in a position to protect the concave bottom 12 from any object resting on top.

Figure 4:
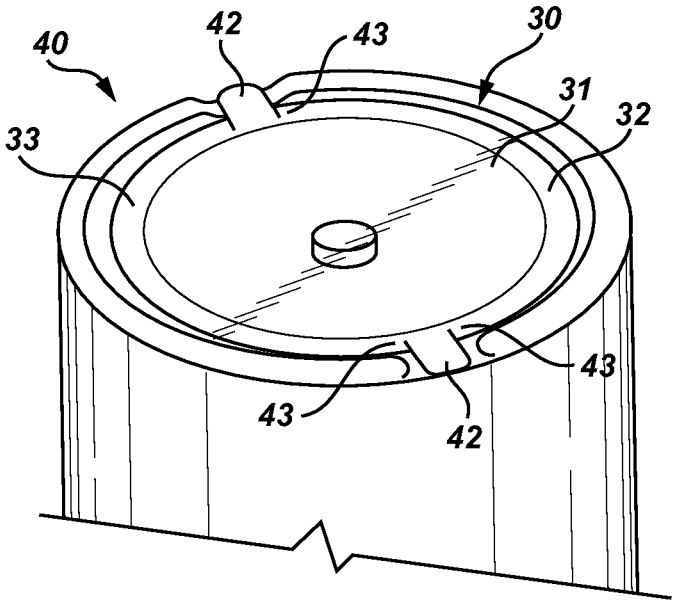
FIG. 4 is a partial perspective view of the bottom showing the tab and notch.
Figure 6:
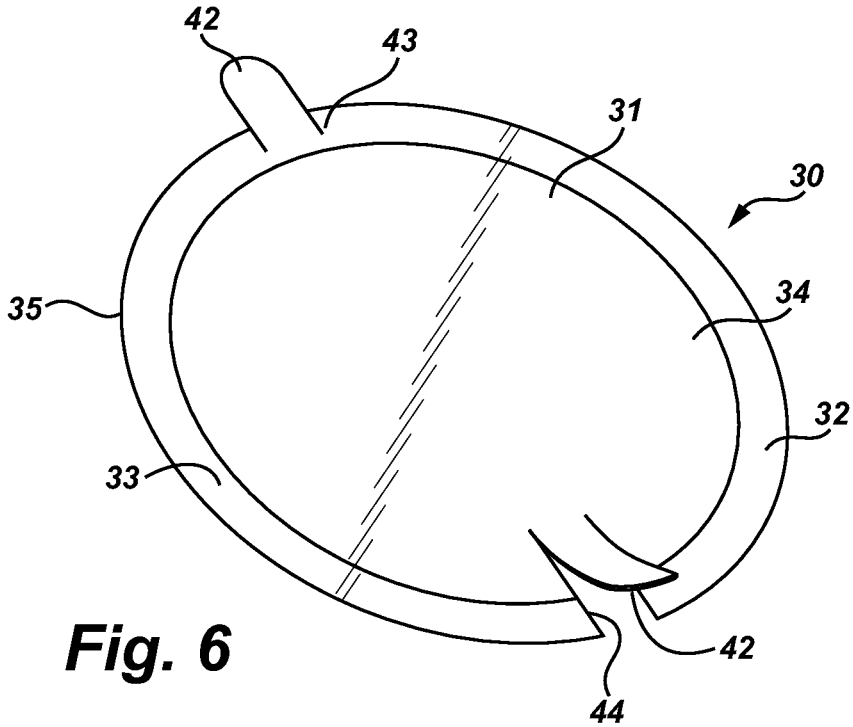
FIG. 6 is a perspective view of the lid.

In the preferred embodiment, the means for retaining 30 comprises a lid 31, as best shown in FIGS. 4 and 6. Lid 31 is secured to the flat surface 15 of the second annular ring 14 by a means for bonding 32. In the preferred embodiment, the means for bonding 32 comprises a pattern heat-seal coating 33, which is adhesively applied by a heated die.

Figure 3:
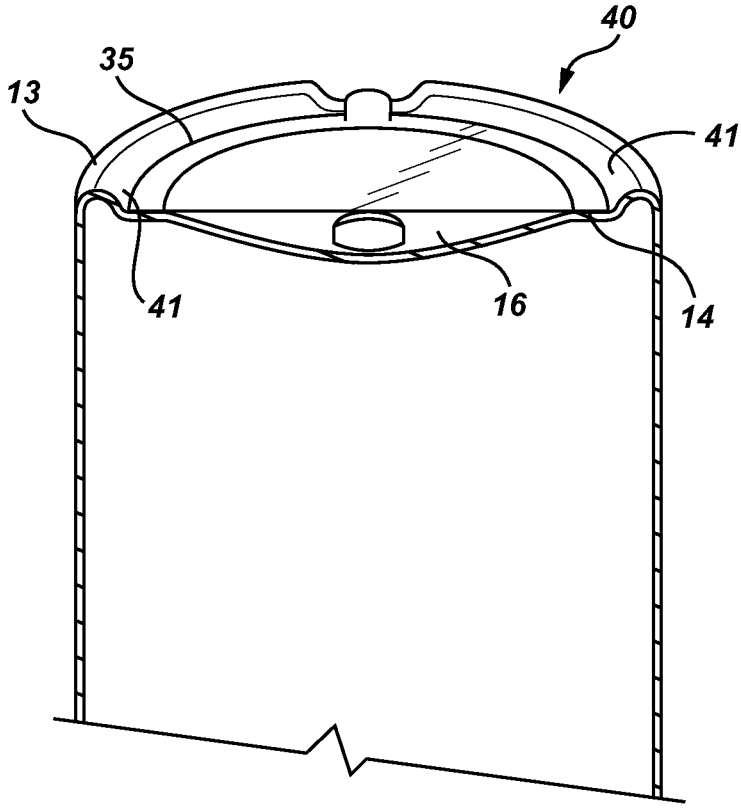
FIG. 3 is a partial section in perspective along the line 3-3 of FIG. 1.

A means for providing an indication of tampering 40 is shown in FIGS. 3 and 4. In the preferred embodiment, the means for providing an indication comprises frustum wall section 41 which joins the first annular ring 13 and the second annular ring 14. A lid edge 35, at the periphery of lid 31, abuts frustum wall section 41 such that access to the edge, for the purpose of lifting it to peel it back, is occluded. Such occlusion prevents someone from lifting the lid intact and rebonding it in place.

Figure 5:
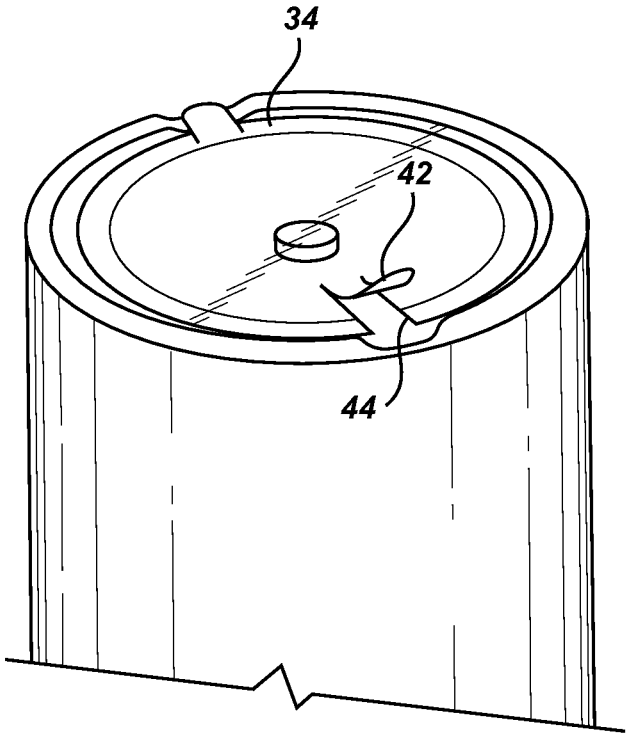
FIG. 5 is a partial perspective view of the bottom showing a peeled tab.

The means for providing an indication of tampering 40 further comprises, in the preferred embodiment, at least one tab 42 extending from lid edge 35, thereby to provide a means for opening cavity 16 to remove solid dosage preparation 2. Tab 42 has at least one notch 43 adjacent its profile which extends partially into the area of pattern heat-seal coating 33 from the lid edge 35. Because notch 43 breaks lid edge 35, a tear 44 will be promulgated, providing a sufficiently frangible composition of lid 31, when tab 42 is lifted (see FIGS. 5 and 6). In the preferred embodiment, lid 31 is a clear film die-cut 34. The opening provided by tear 44 provides access to solid dosage preparation 2, but it also provides a witness to a previous attempt to gain access.

Clear film die-cut 44 allows solid dosage preparation 2 to be viewed inside cavity 16. If bottle 10 stands on its bottom surface, which surface is first annular ring 13, the view of cavity 16 can be obstructed by the opacity of the bottle, or by light reflection at the refractive interfaces. Since the location of the solid dosage preparation 2, not to mention the verification of its presence, should be rendered obvious to the user, it is useful to invert the bottle 10 to stand on the closure 20. To facilitate that purpose, stand-up cap 21 is provided for closure 20 in the preferred embodiment (FIG. 2). Stand-up cap 21 is broad enough to extend the substrate contact surface substantially beyond the plumb line of the center of gravity of the filled bottle.

In spite of the protective offset provided by first annular ring 13, lid 31 might be subject to inadvertent rupture, particularly in the case of a frangible film. As an additional protective measure, solid dosage preparation 2 could be placed inside of a tube (not shown) with the tube axis aligned with the longitudinal direction of the bottle. The tube, designed with sufficient axial compression strength, should extend from the bottom of cavity 16 to the bottom of lid 31 to thereby provide structural support for the lid. The tube may be of spiral-wound paper or extruded plastic construction.

Water bottle 10 can be formed by known methods in a variety of thermoplastic materials. In the preferred embodiment, the bottle is blow-molded from polyethylene terephthalate (PETE), which is a clear resin of the polyester family. Similarly, production methods and materials for the closure 20 can be selected from those well known by practitioners in the art. In the preferred embodiment, closure 20 is injection molded from one, or a combination of, polypropylene (PP) or polyethylene (PE), both of which are commodity resins generically known as polyolefin's. Lid 31 can be comprised of any film or foil of paper, polymer or aluminum construction. In the preferred embodiment, lid 31 is die cut from a non-oriented clear film of the polyester or acetate families. Solid dosage preparation 22 can be granulated, compressed, or comminuted in accordance with known methods, typically in the domain of pharmaceuticals.

While a particular form of the invention has been illustrated and described, it will be apparent that various modifications can be made without departing from the spirit and scope of the invention. For example: (i) The lidding may be applied to the first annular ring, thereby eliminating the need for customized tooling to provide the second annular ring; (ii) Literature may be provided in the cavity, along with the dosage. Accordingly, it is not intended that the invention be limited, except as by the appended claims.

What is claimed is:

1. An enhanced water product with safety feature, comprising:

a water bottle containing water and having an elongated body with a neck finish on one end and a concave bottom on the other end, the concave bottom having a first annular ring at the periphery of the elongated body and a second annular ring recessed from, and inboard of, the first annular ring, the second annular ring having a flat surface bounded by an inside periphery and an outside periphery, said inside periphery defining a cavity with the concave bottom;

a closure sealingly fitted to the neck finish;

a solid dosage preparation protectively housed in the cavity;

a means for retaining the solid dosage preparation in the cavity, said means having a peripheral edge, the solid dosage preparation being visible at a glance within said means; and a frustum wall section joining the first annular ring and the second annular ring at the outside periphery thereof, the frustum wall section providing an abutment surface for the means for retaining the solid dosage preparation, the abutment surface rendering the edge of the means for retaining abutted thereto substantially inaccessible for the purpose of peeling it away and exposing the cavity;

whereby the solid dosage preparation is conveyed together with the water bottle and an integrated means for providing an indication of tampering, should pre-purchase access to the cavity be attempted, is comprised of the inaccessibility of the abutted edge.

2. The enhanced water product of claim 1, wherein the means for retaining comprises a clear film die-cut lid attached by a means for bonding to the flat surface of the second annular ring.

3. The enhanced water product of claim 2, wherein the means for bonding comprises a pattern heat-seal coating on the lid.

4. The enhanced water product of claim 2, wherein the lid is frangible and the integrated means for providing an indication of tampering further comprises at least one tab extending from the periphery of the lid, the periphery perforated by at least one notch adjacent the tab, the notch serving to break the edge so as to propagate a tear in the lid when the tab is lifted, the tear giving, at once, preferred access to the cavity and evidence of any prior attempt to gain access.

5. The enhanced water product of claim 1, further comprising a means for visually inspecting the solid dosage preparation.

6. The enhanced water product of claim 5, wherein the means for visually inspecting comprises a stand-up cap closure, said closure sufficiently broad of contact surface for a stable stance, and a bottom-up bottle orientation.

7. An enhanced water product with safety feature, comprising:

a water bottle containing water and having an elongated body with a neck finish on one end and a concave bottom on the other end, the concave bottom having a first annular ring at the periphery of the elongated body and a second annular ring recessed from, and inboard of, the first annular ring, the second annular ring having a flat surface bounded by an inside periphery and an outside periphery, said inside periphery defining a cavity with the concave bottom;

a closure sealingly fitted to the neck finish;

a solid dosage preparation protectively housed in the cavity;

a clear film die-cut lid bonded to the flat surface of the second annular ring to retain the solid dosage preparation thereby, said lid having a peripheral edge; and a frustum wall section joining the first annular ring and the second annular ring at the outside periphery thereof, the frustum wall section providing an abutment surface for the lid, the abutment surface rendering the edge of the lid abutted thereto substantially inaccessible for the purpose of peeling it away and exposing the cavity;

whereby the solid dosage preparation is conveyed together with the water bottle and an integrated means for providing an indication of tampering, should pre-purchase access to the cavity be attempted, is comprised of the inaccessibility of the abutted edge.

8. The enhanced water product of claim 7, wherein the lid is frangible and the integrated means for providing an indication of tampering further comprises at least one tab extending from the periphery of the lid, the periphery perforated by at least one notch adjacent the tab, the notch serving to break the edge so as to propagate a tear in the lid when the tab is lifted, the tear giving, at once, preferred access to the cavity and evidence of any prior attempt to gain access.

9. The enhanced water product of claim 7, further comprising a means for visually inspecting the solid dosage preparation.

10. The enhanced water product of claim 9, wherein the means for visually inspecting comprises a stand-up cap closure, said closure sufficiently broad of contact surface for a stable stance, and a bottom-up bottle orientation.

* * * * *